US010327565B2

(12) United States Patent
Sozzo et al.

(10) Patent No.: US 10,327,565 B2
(45) Date of Patent: Jun. 25, 2019

(54) HIGH CHAIR FOR CHILDREN CONVERTIBLE INTO A BOOSTER SEAT

(71) Applicant: ARTSANA S.P.A., 22070 Grandate (CO) (IT)

(72) Inventors: David Sozzo, Milan (IT); Giuseppe Mascarella, Cantu (IT)

(73) Assignee: ARTSANA S.P.A., Grandate (IT)

( * ) Notice: Subject to any disclaimer, the term of this patent is extended or adjusted under 35 U.S.C. 154(b) by 270 days.

(21) Appl. No.: 15/344,241

(22) Filed: Nov. 4, 2016

(65) Prior Publication Data

US 2017/0127850 A1 May 11, 2017

(30) Foreign Application Priority Data

Nov. 6, 2015 (IT) ..... 102015000070080

(51) Int. Cl.

| | |
|---|---|
| ***A47D 1/10*** | (2006.01) |
| ***A47D 15/00*** | (2006.01) |
| ***A47D 1/02*** | (2006.01) |
| ***A47C 31/11*** | (2006.01) |
| ***A47D 1/00*** | (2006.01) |
| ***A47C 7/42*** | (2006.01) |

(52) U.S. Cl.
CPC ..... *A47D 1/103* (2013.01); *A47C 7/425* (2013.01); *A47C 31/11* (2013.01); *A47D 1/00* (2013.01); *A47D 1/02* (2013.01); *A47D 15/006* (2013.01)

(58) Field of Classification Search
CPC ..... A47D 1/103; A47D 1/004; A47C 7/425
See application file for complete search history.

(56) References Cited

U.S. PATENT DOCUMENTS

| | | | | |
|---|---|---|---|---|
| 3,471,199 | A * | 10/1969 | Kuhlmann | A47C 4/02 297/411.41 |
| 5,498,065 | A | 3/1996 | Tosoni | |
| 5,531,502 | A * | 7/1996 | Berggren | A47D 1/004 297/131 |
| 5,951,102 | A | 9/1999 | Poulson et al. | |
| 6,033,019 | A * | 3/2000 | Hession-Kunz | A47D 1/002 297/250.1 |
| 7,104,603 | B2 * | 9/2006 | Keegan | A47D 1/004 297/151 |

(Continued)

FOREIGN PATENT DOCUMENTS

| | | |
|---|---|---|
| EP | 0 630599 A1 | 12/1994 |
| EP | 2 008 550 A1 | 12/2008 |
| WO | 2013/155250 A1 | 10/2013 |

*Primary Examiner* — David R Dunn
*Assistant Examiner* — Tania Abraham
(74) *Attorney, Agent, or Firm* — Pearne & Gordon LLP

(57) ABSTRACT

The present invention relates to a high chair for children convertible into a booster seat comprising an upper part and a base, the upper part having a seating surface adapted for engagement with a corresponding bearing surface of the base, lateral armrest sides, a backrest whose perimeter boundary extends from one lateral side to the other, as well as a backrest extension extending in cantilever fashion from the perimeter boundary of the backrest.
The backrest extension consists of a body separate from the backrest and comprises members for removable connection to the perimeter boundary of the backrest. When the backrest extension is removed, the upper part of the high chair is used as a booster seat.

5 Claims, 9 Drawing Sheets

(56) References Cited

U.S. PATENT DOCUMENTS

| | | | | |
|---|---|---|---|---|
| 7,871,125 | B2 * | 1/2011 | Asbach | A47D 1/004 297/256.11 |
| 8,567,867 | B2 * | 10/2013 | Arnold, IV | A47D 1/002 297/250.1 |
| 9,101,225 | B2 * | 8/2015 | Kostyniak | A47D 1/00 |
| 2009/0001776 | A1 | 1/2009 | Bearup et al. | |
| 2013/0285421 | A1 | 10/2013 | Huntsberger et al. | |

* cited by examiner

HIGH CHAIR FOR CHILDREN CONVERTIBLE INTO A BOOSTER SEAT

TECHNICAL FIELD

The present invention relates to a high chair for children convertible into a booster seat comprising an upper part and a base, the upper part having a seating surface adapted for engagement with the base, lateral armrest sides, a backrest whose perimeter boundary extends from one lateral side to the other, as well as a backrest extension extending in cantilever fashion from the perimeter boundary of the backrest.

BACKGROUND OF THE INVENTION

In the prior art, in compliance with safety standards, high chairs for children have the upper part secured to the base by means of coupling members which allow it to be removed and placed on a normal adult chair to act as a booster seat.

Such arrangement allows, for instance, children to sit at the same table as adults, and is particularly useful when a child is too small to use a normal adult chair but has grown enough to find the high chair too narrow and uncomfortable, or when the use of the high chair is not practical (for example for size restrictions)

In the prior art, in compliance with safety standards, the upper part of high chairs, which is designed to receive very small children, has a backrest that encircles the shoulders of the child when he/she sits on the seating surface.

When the upper part of a high chair is removed from the base to act as a booster seat, the encircling configuration of the backrest causes the booster seat to have a large size, and be difficultly transported and used in non-domestic environments.

Furthermore, if the booster seat is used by a child that has grown enough to stop using the high chair, the backrest of the booster seat, due to its large size, will make the use of the booster seat quite inconvenient.

The object of the present invention is to obviate the drawbacks associated with the use of the upper part of a high chair as a booster seat.

Particularly, one object of the present invention is to provide a high chair for children convertible into a booster seat, in which the booster seat can be easily transported. Another object of the present invention is to provide a high chair for children convertible into a booster seat that can be also used by children that no longer need a high chair.

SUMMARY OF THE INVENTION

These and other objects, as better explained hereafter, are fulfilled by a high chair whose upper part, removable from the base, is as defined in one or more of the accompanying claims.

BRIEF DESCRIPTION OF THE FIGURES

The invention will be now described in greater detail with reference to the annexed drawings, which show a preferred embodiment of the invention, given by way of illustration and without limitation, in which.

DETAILED DESCRIPTION OF THE INVENTION

Figure 1:
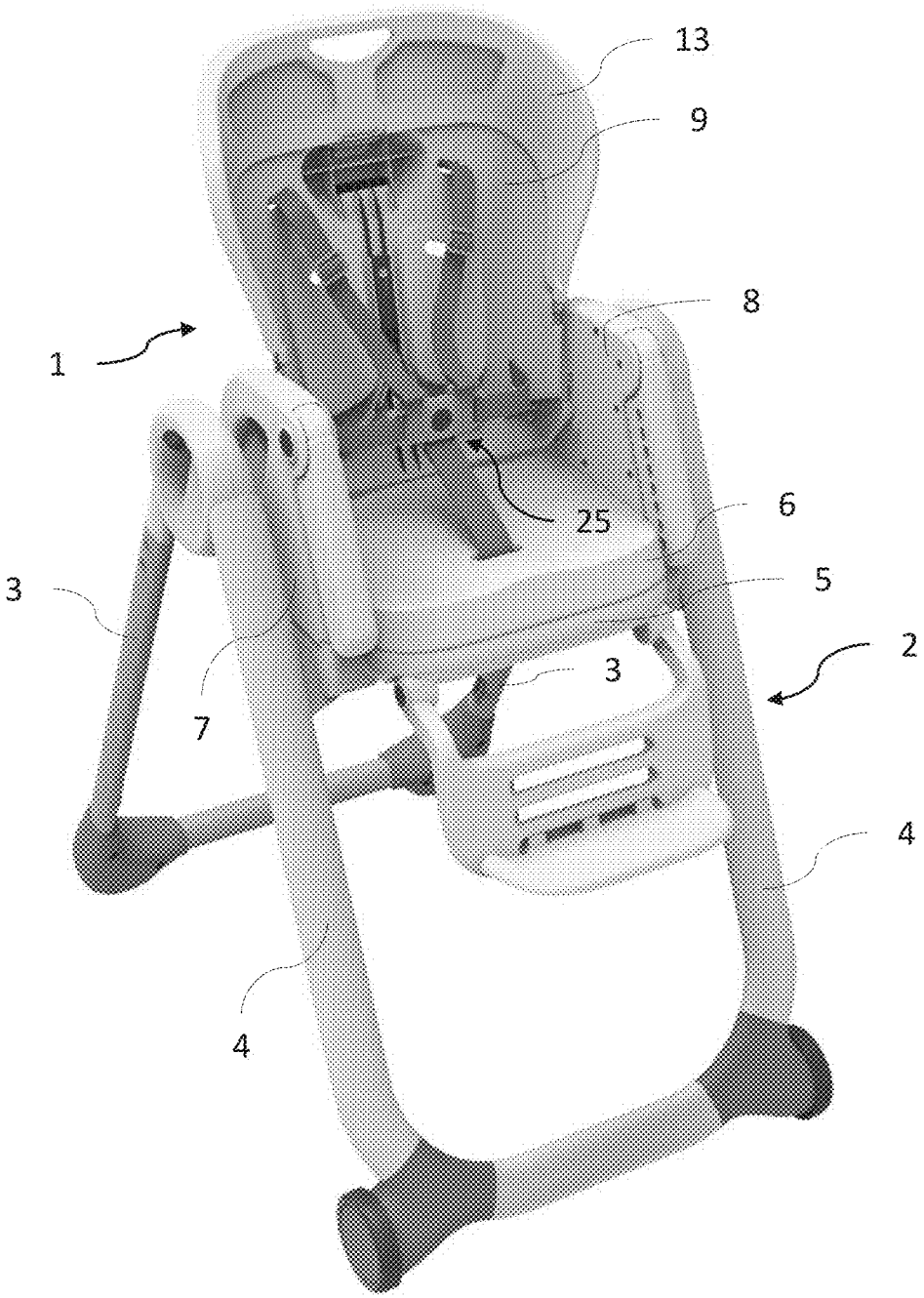
FIG. 1 shows a perspective view of the structure of a high chair of the invention, with the upper part secured to the underlying base.
Figure 2:
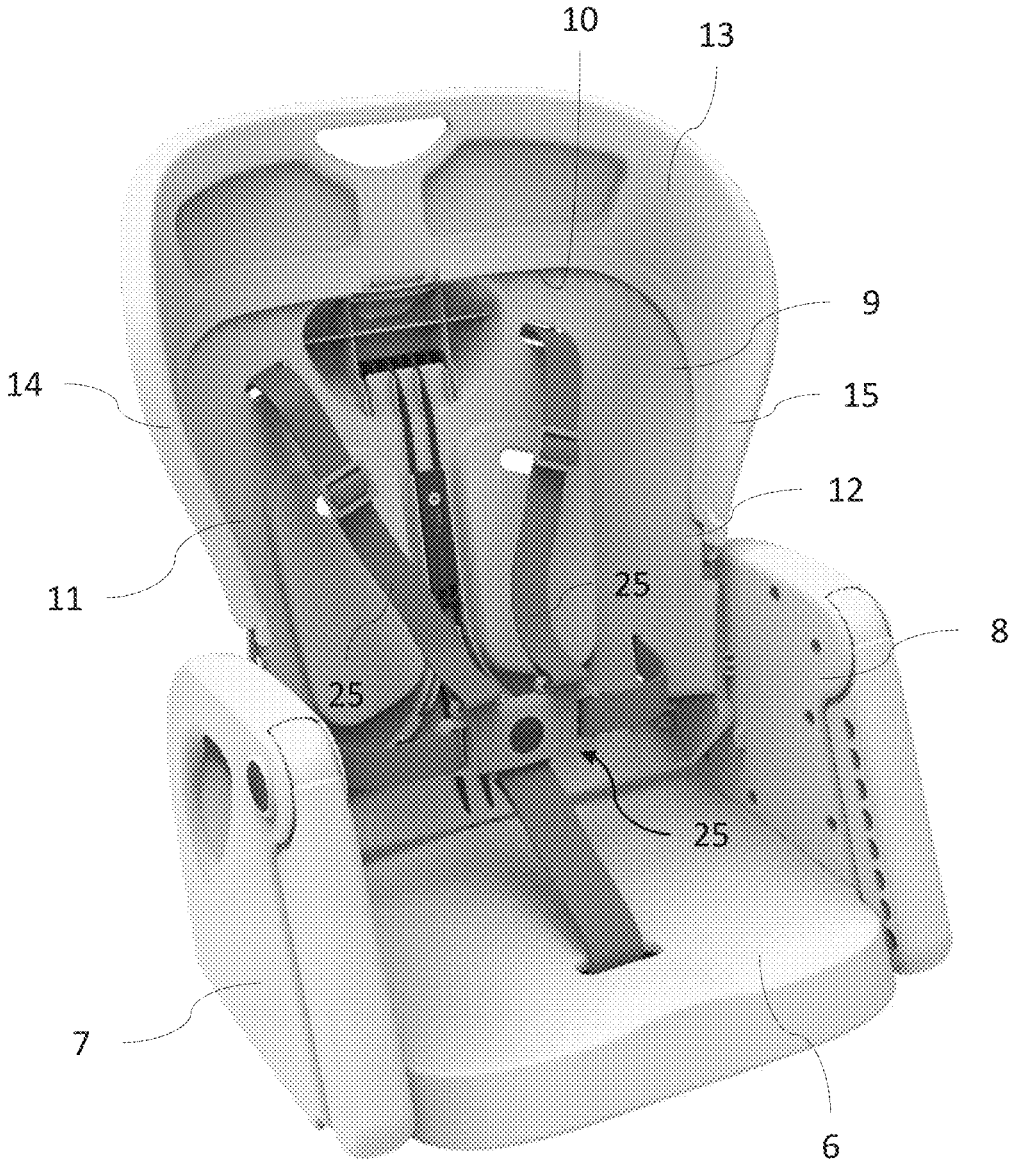
FIG. 2 shows a front perspective view of the structure of the upper part of the high hair of FIG. 1.
Figure 3:
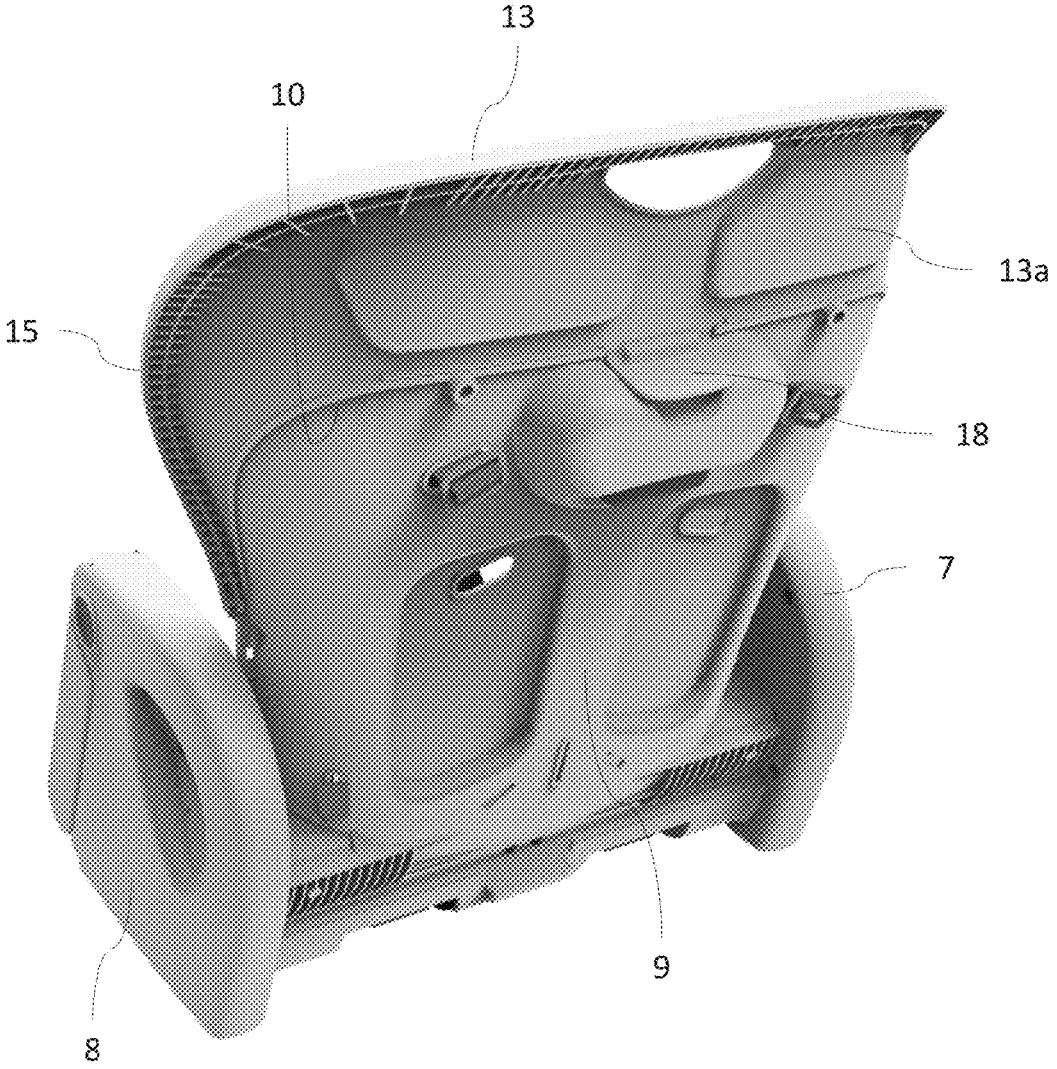
FIG. 3 shows a rear perspective view of the structure of the upper part of the high hair of FIG. 1.
Figure 4:
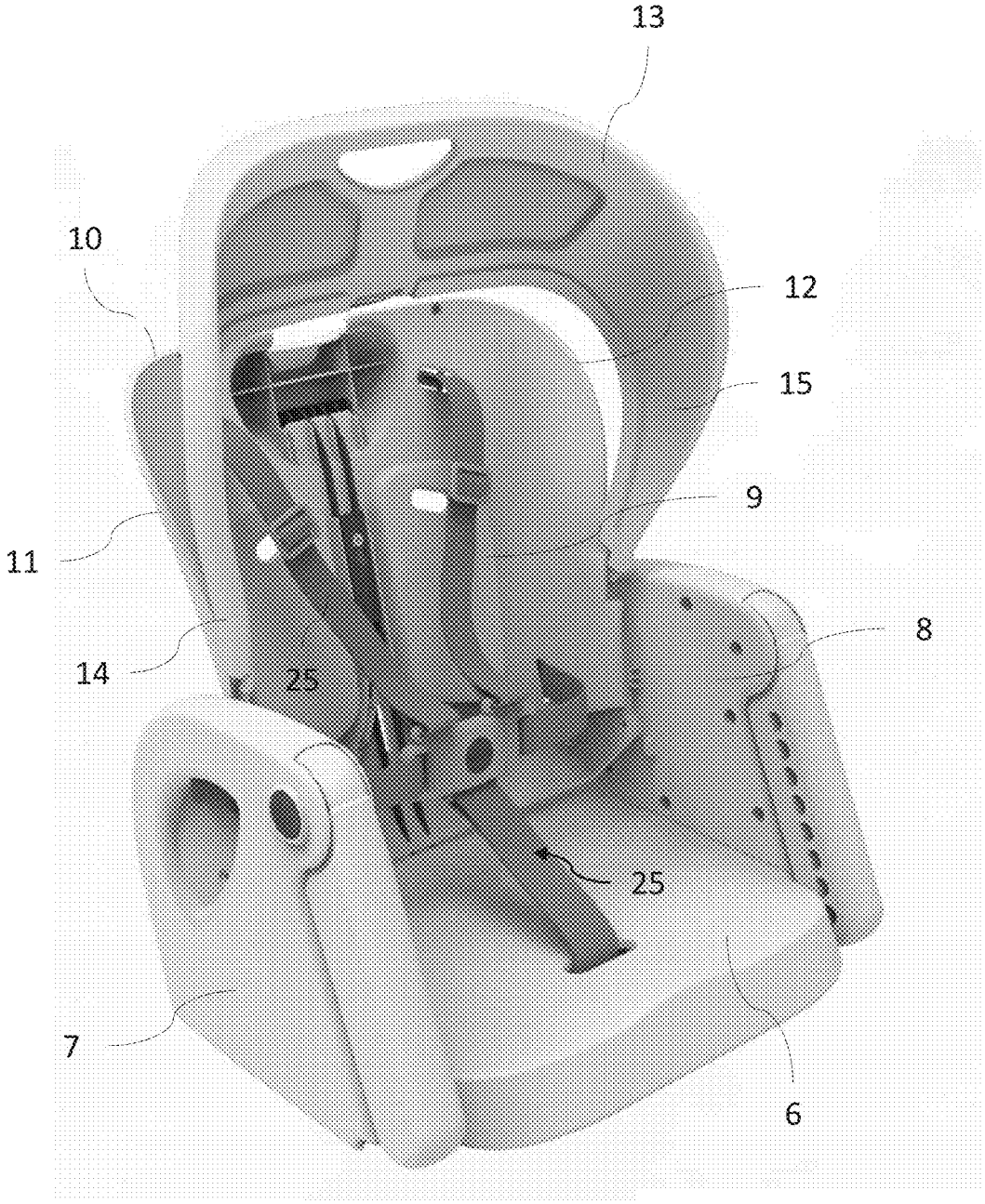
FIG. 4 shows a front perspective view of the structure of FIG. 2, with a backrest extension in a first position, assumed during removal thereof.
Figure 5:
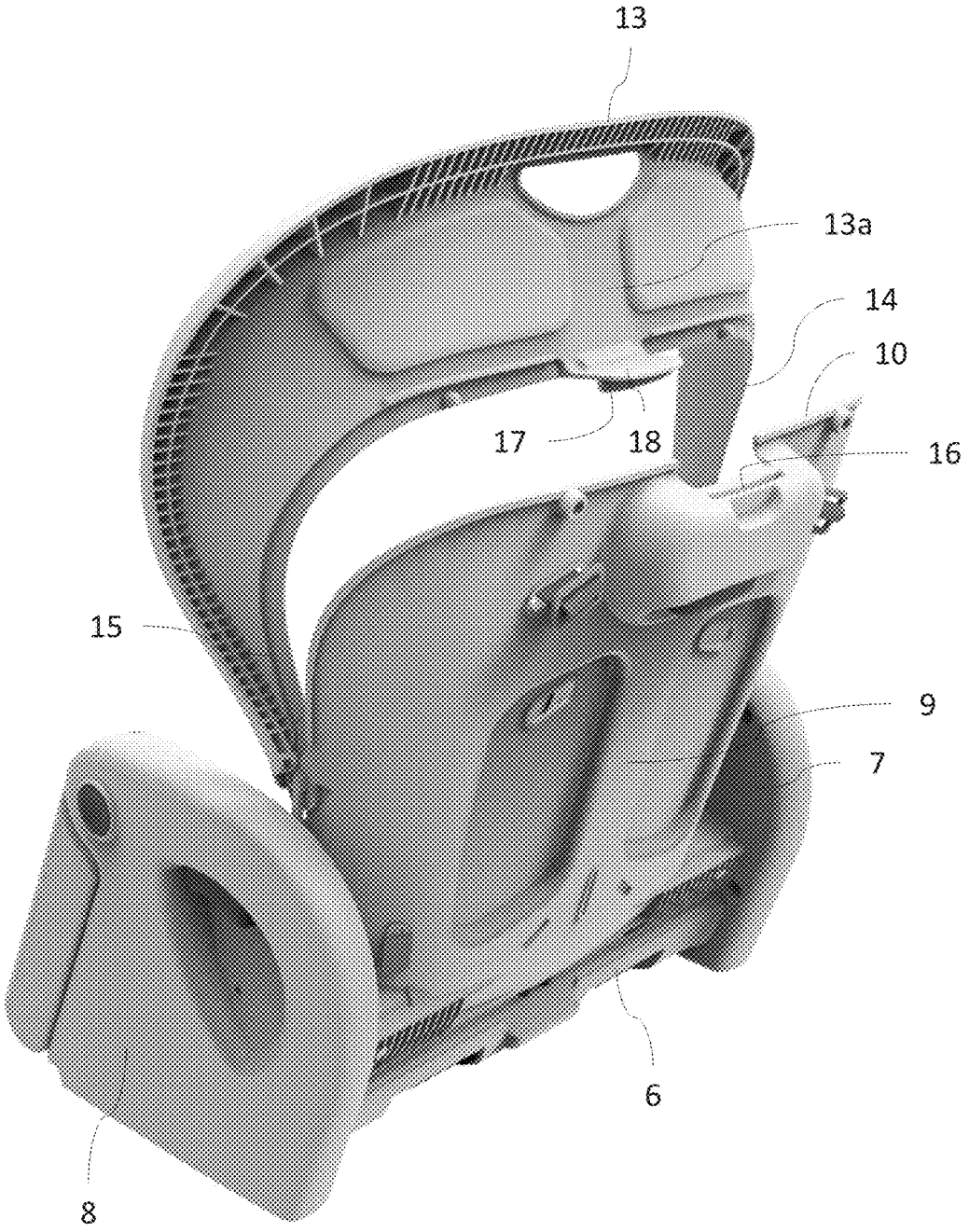
FIG. 5 shows a rear perspective view of the structure as shown in FIG. 4.
Figure 6:
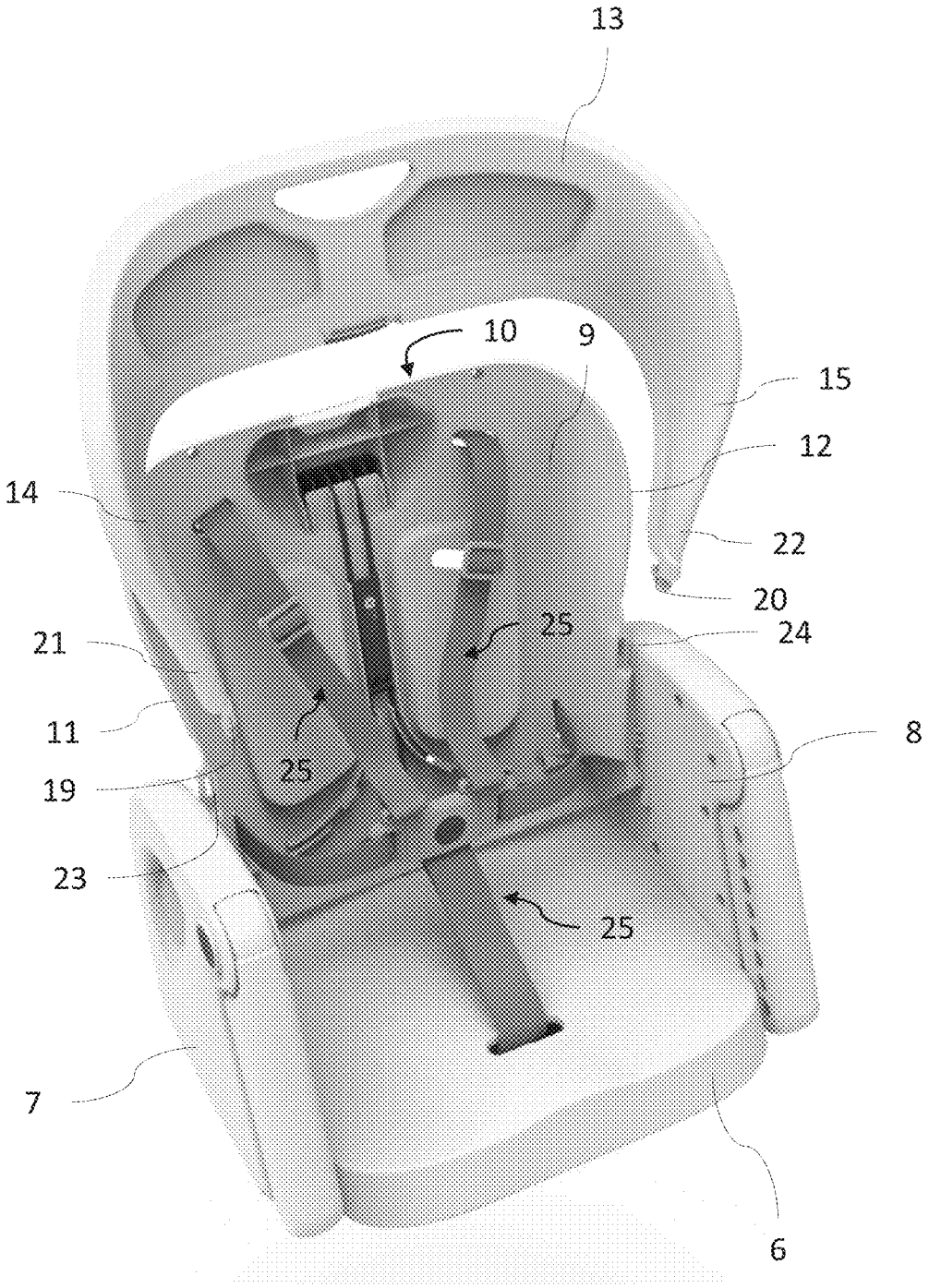
FIG. 6 shows a front perspective view of the structure of FIG. 2, with the backrest extension in a position in which it is separate from the backrest.
Figure 7:
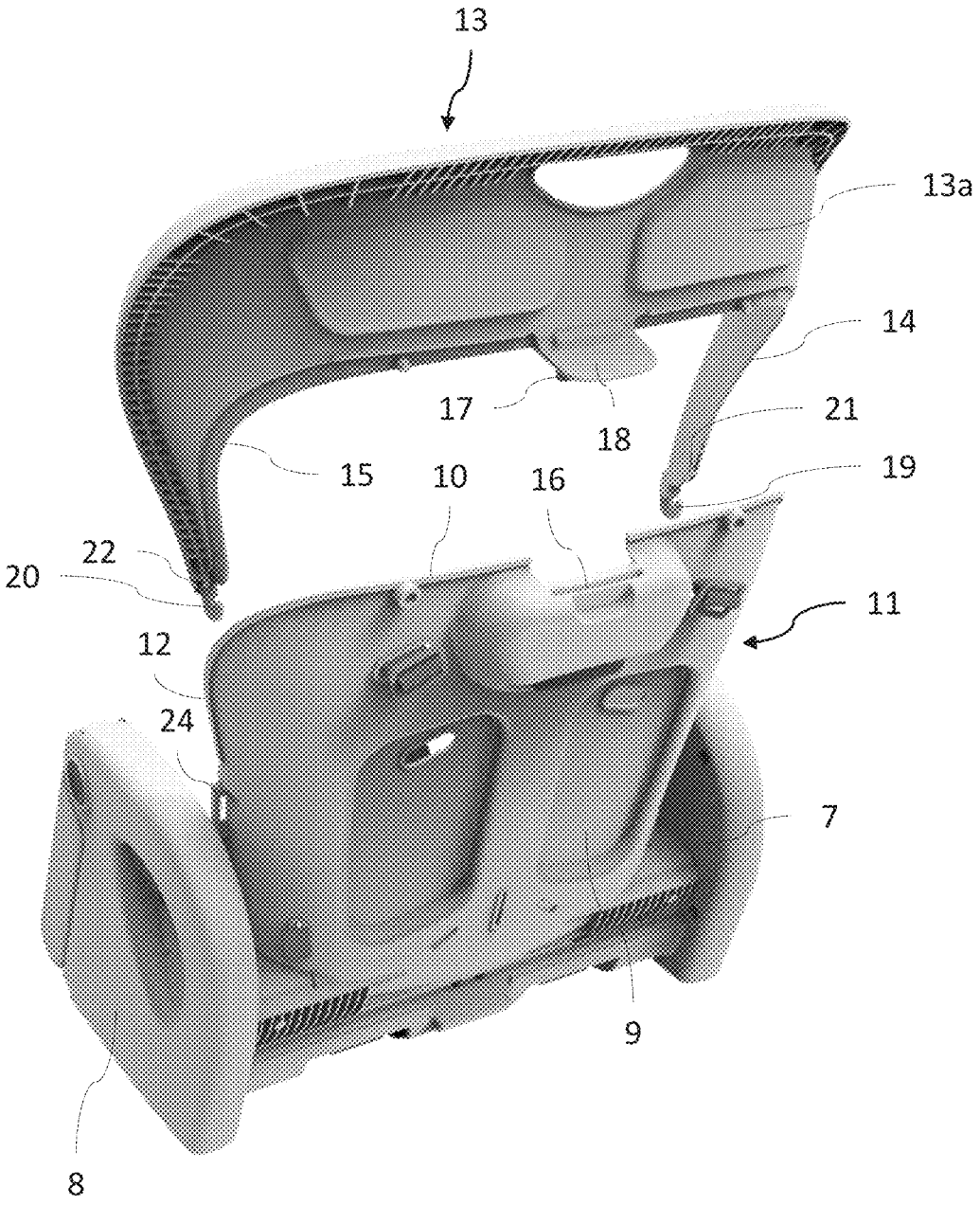
FIG. 7 shows a rear perspective view of the structure as shown in FIG. 6.
Figure 8:
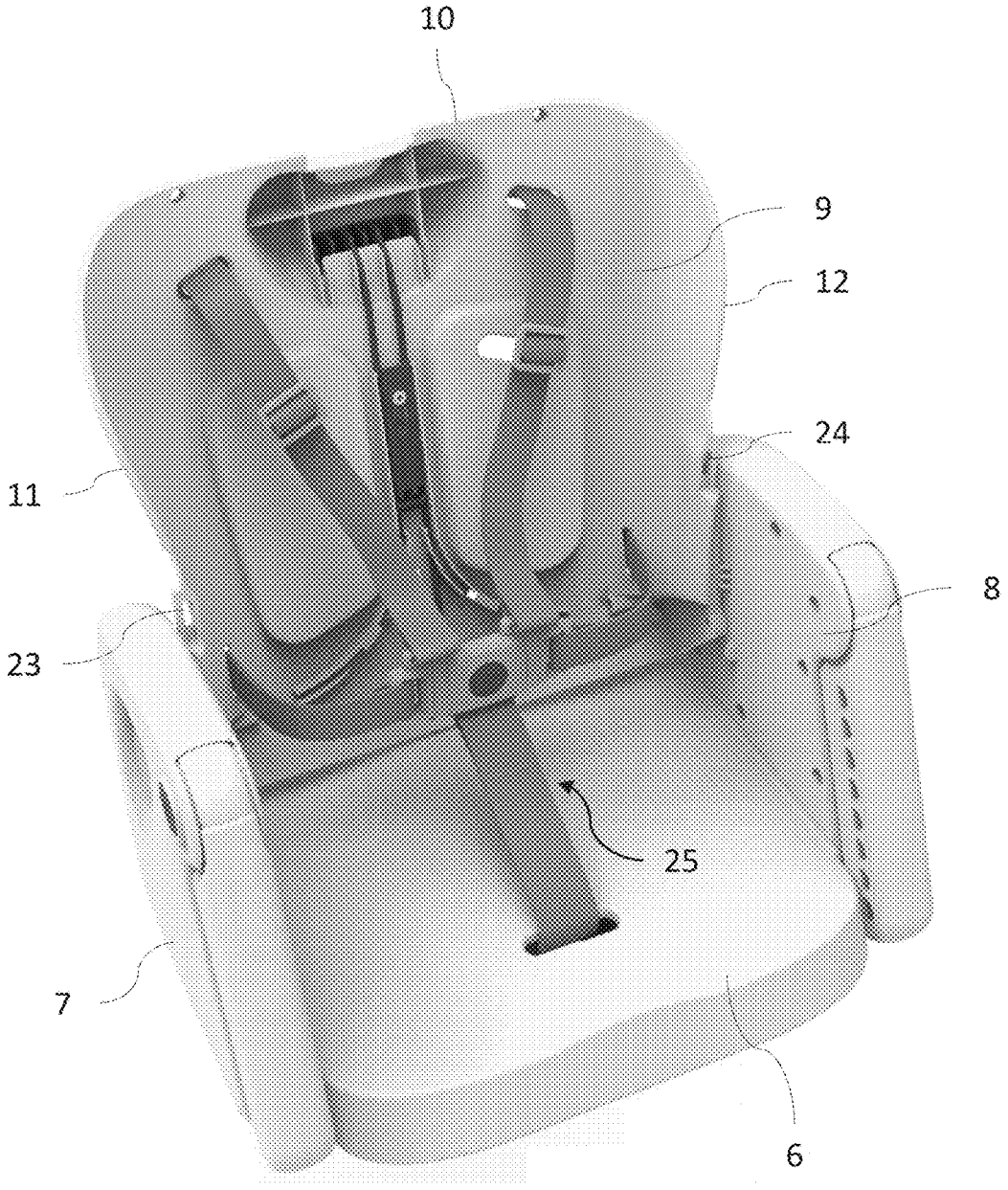
FIG. 8 shows a front perspective view of the upper part of the high chair of FIG. 1, with the backrest extension entirely removed from the base, to be employed as a booster seat.
Figure 9:
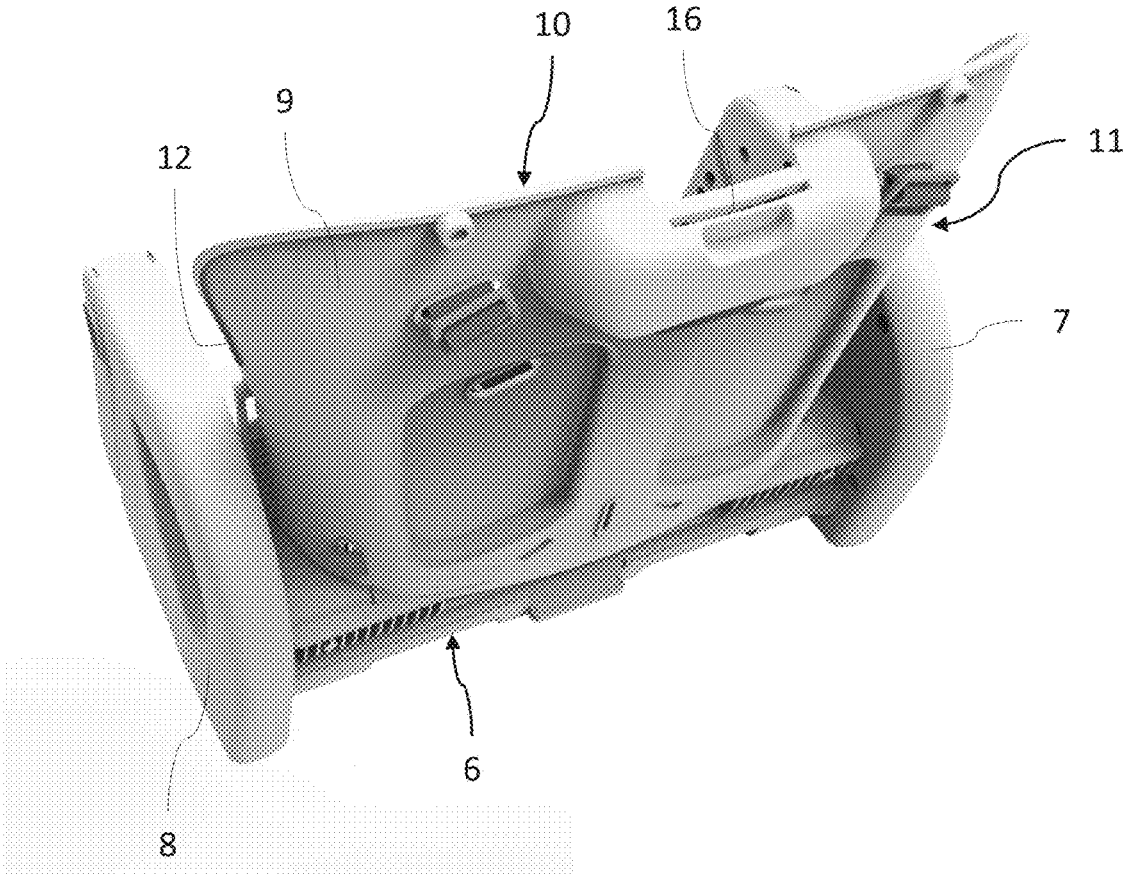
FIG. 9 shows a rear perspective view of the structure as shown in FIG. 8.

Referring to the accompanying figures, and particularly to FIG. 1, the high chair of the invention comprises an upper part, generally referenced 1, and a base, generally referenced 2.

In the illustrated embodiment the base comprises two structures, i.e. a front structure and a rear structure, referenced 3 and 4. Each of the front and rear structures 3, 4 is composed of tubular elements that are bent into a C configuration.

These structures 3, 4 are hinged along a horizontal connection axis X-X about which they can be opened and folded in tripod fashion.

The base has mechanical connection members, e.g. a surface 5 designed to have the upper part 1 removably connected thereto to form a child seat. In the preferred embodiment of the invention, the upper part 1 has a seating surface 6 adapted to be coupled to the surface 5 of the base.

The seating surface 6 has lateral sides 7 and 8 and a backrest 9 connected thereto.

The latter has a perimeter boundary comprises a top section 10 and two lateral sections 11, 12 each facing its respective lateral side 7, 8.

The backrest 9 also has a backrest extension 13, which extends in cantilever fashion from the perimeter boundary of the backrest 9 itself.

Such backrest extension 13 consists of a body separate from the backrest 9 of said upper part of the high chair and comprises members for removable connection to the perimeter boundary of the backrest 9, as better explained hereinbelow.

This extension 13 of the backrest 9 comprises lateral portions 14 and 15 which extend along said lateral sections 11, 12 of the backrest 9 that face the lateral sides 7, 8. The members for removable connection of said backrest extension 13 to the backrest 9 comprise interlocking members consisting, in the preferred exemplary embodiment, of a groove 16 formed in the top section 10 of the boundary of the backrest 9 and a corresponding tongue 17 on the extension 13. The tongue 17 is placed on an operating member, preferably a flat wing 18 which projects in cantilever fashion from the rear side 13*a* of the backrest extension 13. The flat wing 18 is elastically connected to the backrest extension, to allow disengagement of the tongue 17 from the groove 16.

The members for removable connection of said backrest extension 13 to the backrest 9 further comprise hook-like elements 19, 20 preferably located at the ends 21, 22 of the lateral portions 14, 15.

Said hook-like elements 19 and 20 are adapted for removable engagement into corresponding slots 23, 24 formed on said lateral sections 11, 12 of the boundary of the backrest 9 facing said lateral sides 7, 8.

It will be appreciated from the above discussion that the backrest extension 13 may be easily removed from the backrest 9 by acting on the handgrip 18 to lift the tongue 17 and remove it from the groove 16 formed in the backrest 9. The extension 13 is fully separated by displacing the extension 13 toward the front side of the backrest 9 with a rotation of the hooks 19 and 20 within their respective slots 23 and 24.

Once the upper portion of the high chair is released from the extension 13, it may be used as a booster seat for a sufficiently grown-up child that might find such extension 13 inconvenient.

Nevertheless, for very small children, the extension 13 may be left connected to the backrest 9 and the upper part 1 of the high chair 1 may be still employed as a booster seat. For this purpose, the upper part 1 of the high chair comprises, as it is known in the art, belts 25 for retaining the child on the seating surface 6, as well as belts, not shown, for removable fixation of an adult chair to the backrest and the seating surface respectively, when said upper part 1 acts as a booster seat.

The high chair of the present invention has been only described with reference to its construction and operation features.

The high chair also comprises a textile cover for the backrest and the backrest extension, not shown. The portion of the textile cover for the backrest extension 13 can be physically separated from the portion of the textile cover for the backrest 9.

Particularly the portion of the textile cover of the backrest extension has a shape that is substantially equal to the shape of the backrest extension. This textile portion is joined to the textile portion of the backrest 9 using connection means such as Velcro or zippers. Thus, once the portion of the textile cover for the backrest 9 has been released from that for the backrest extension 13, the latter can be removed.

The invention claimed is:

1. A high chair for children convertible into a booster seat, comprising:

an upper part and a base, the upper part having a seating surface for removable engagement with said base, the seating surface having a front portion, first and second lateral side portions and a rear portion, first and second lateral armrest sides, the first lateral armrest side extending from the first lateral side portion, the second lateral armrest side extending from the second lateral side portion, a backrest extending from the rear portion of the seating surface, the backrest having a perimeter boundary comprising a top perimeter section, a bottom perimeter section and first and second lateral perimeter sections, the first lateral perimeter section extending from the top perimeter section to the bottom perimeter section, a portion of the first lateral perimeter section being located adjacent the first lateral armrest side, the second lateral perimeter section extending from the top perimeter section to the bottom perimeter section, a portion of the second lateral perimeter section being located adjacent the second lateral armrest side, a backrest extension extending in cantilever fashion from the perimeter boundary of the backrest, and consisting of a body that can be separated from the backrest of said upper part of the high chair, members for removable connection of the backrest extension to the perimeter boundary of the backrest, characterized in that said backrest extension comprises lateral portions which extend downwardly along said first and second lateral perimeter sections, said members for removable connection comprising hook-like elements located at the ends of the lateral portions of the backrest extension and adapted for removable engagement into corresponding slots formed on said first and second lateral perimeter sections of the perimeter boundary.

2. The high chair for children as claimed in claim 1, wherein said members for removable connection comprise interlocking elements.

3. The high chair for children as claimed in claim 2, wherein said interlocking elements comprise at least one operating element for insertion and removal thereof.

4. The high chair for children as claimed in claim 1, wherein said upper part comprises belts for removable fixation to the backrest and the seating surface of an adult chair respectively, when said upper part acts as a booster seat.

5. The high chair for children as claimed in claim 1, comprising a cover made of textile material for at least the backrest and the backrest extension, the portion of the textile cover for the backrest extension being a textile body separated from the rest of the textile cover and removably connected to at least the portion of the textile cover for the backrest.

* * * * *